US006086408A

United States Patent [19]

Tanigawa

[11] Patent Number: 6,086,408

[45] Date of Patent: Jul. 11, 2000

[54] ELECTRIC LAMP SOCKET AND METHOD OF CONNECTING ELECTRIC LAMP SOCKET AND WIRE

[75] Inventor: Fumiyoshi Tanigawa, Yokkaichi, Japan

[73] Assignee: Sumitomo Wiring Systems, Ltd., Mie, Japan

[21] Appl. No.: 09/137,116

[22] Filed: Aug. 20, 1998

[30] Foreign Application Priority Data

Aug. 20, 1997 [JP] Japan ..... 9-223452

[51] Int. Cl.[7] ..... H01R 4/24

[52] U.S. Cl. ..... 439/419; 439/397; 439/417

[58] Field of Search ..... 439/419, 414, 439/409, 417, 699.2, 918, 56, 57, 58, 397

[56] References Cited

U.S. PATENT DOCUMENTS

| | | | |
|---|---|---|---|
| 1,849,846 | 3/1932 | McNeil . | |
| 4,360,962 | 11/1982 | Suzuki et al. | 29/564.4 |
| 4,496,206 | 1/1985 | Markwardt et al. | 439/409 |
| 4,653,829 | 3/1987 | LaMont . | |
| 5,173,062 | 12/1992 | Uchida | 439/918 |
| 5,460,539 | 10/1995 | Gallone | 439/417 |
| 5,647,761 | 7/1997 | Kaminski | 439/419 |
| 5,797,766 | 8/1998 | Tanigawa | 439/419 |

FOREIGN PATENT DOCUMENTS

| | | |
|---|---|---|
| 06-175117 | 9/1994 | Japan . |
| 6-275117 | 9/1994 | Japan . |

*Primary Examiner*—Paula Bradley
*Assistant Examiner*—Tho D. Ta
*Attorney, Agent, or Firm*—Oliff & Berridge, PLC

[57] ABSTRACT

An electric lamp socket includes first and second parts which are adapted to be fitted and locked together. The first part has at least one wire-receiving surface and the second part has a wire-contact metal terminal. A method of connecting the electric lamp socket and at least one electric wire includes the steps of removably locating the first part of the electric lamp socket at a predetermined position on a jig defining a planar wire-laying path, such that the wire receiving surface lies in the planar wire-laying path, laying the wire along the wire-laying path and on the wirereceiving surface, fitting and locking the second part of the electric lamp socket to the first part thereof so that the wire-contact metal terminal engages the wire laid on the wire-receiving surface so as to make electrical connection therewith, and removing the electric lamp socket and the wire connected thereto from the jig.

16 Claims, 11 Drawing Sheets

ELECTRIC LAMP SOCKET AND METHOD OF CONNECTING ELECTRIC LAMP SOCKET AND WIRE

BACKGROUND OF THE INVENTION

1. Field of Invention

The present invention relates to a method of connecting an electric lamp socket and at least one electric wire, and to electric lamp sockets themselves. The electric lamp sockets may be used in the method. The electric lamp socket is a socket adapted to receive and hold an electric light bulb. Such a socket will herein for convenience be called a bulb socket. The invention is especially but not exclusively applicable to the wiring of a bulb socket for use in an automobile or other vehicle.

2. Description of Related Art

JP-A-6-275117 discloses a method of connecting electric wires to a plurality of bulb sockets of a combination lamp to be positioned at a rear portion of a vehicle body. In this method, as shown in FIG. 13, on a surface of a back cover 1 which is to be installed so as to close a space of the vehicle body for accommodating the combination lamp, an electric wire-laying path 4 associated with locking projections 2 and receiving portions 3 for receiving a crimped electric wire (W) electric wires (W) are laid along the path 4 by an automatic electric wire-laying device (not shown) and temporarily locked to the locking projections 2. After laying of the electric wires (W) along the path 4, bulb sockets 5 are fixed to the back cover 1, with each bulb socket 5 positioned on each receiving portion 3 installed on a portion of the path 4. As a result, a crimping terminal metal fitting (not shown) installed on the lower surface of the bulb socket 5 is pressed against the electric wires (W), thus connecting the electric wires (W) and the bulb socket 5. Thereafter, the back cover 1 on which the electric wires (W) and the bulb sockets 5 have been installed is mounted on the vehicle body.

In this method, the bulb socket 5 is installed on the flat back cover 1, and the electric wires (W) are laid in a plane. In another known kind of a combination lamp, a plurality of bulb sockets is installed three-dimensionally over the back cover. In such a case, because the electric wire-laying path extends three-dimensionally, it is necessary for the automatic electric wire-laying device to move three-dimensionally, which causes the electric wire-laying operation to be performed less efficiently and the cost for equipping the automatic electric wire-laying device to be higher than for the connection means having the automatic electric wire-laying device which is required to move only two-dimensionally.

A disadvantage of a socket arrangement as shown in FIG. 13 is the risk of disengagement of the wires from the socket terminals, if the wires are disturbed during handling or in use.

SUMMARY OF THE INVENTION

It is an object of the present invention to allow an automatic electric wire-laying device to lay electric wires with high efficiency in the connection of electric lamp sockets and reduce the cost of preparing and operating the automatic electric wire-laying device.

It is also an object of this invention to provide an electric bulb socket which is easy to connect to an electric wire or wires and provides a secure connection to the wire or wires.

In a first aspect of the invention, there is provided a method of connecting at least one electric lamp socket and at least one electric wire. The electric lamp socket comprises first and second parts which are adapted to be fitted and locked together, the first part having at least one wire-receiving surface and the second part having a wire-contact metal terminal. The method comprises the steps of (i) removably locating the first part of the electric lamp socket at a predetermined position on a jig defining a planar wire-laying path, such that the wire-receiving surface lies in the planar wire-laying path, (ii) laying the wire along the wire-laying path and on the wire-receiving surface, (iii) fitting and locking the second part of the electric lamp socket to the first part thereof so that the wire-contact metal terminal engages the wire on the wirereceiving surface so as to make electrical connection therewith, and (iv) removing the electric lamp socket and the wire connected thereto from the jig.

In a second aspect of the invention, there is provided in combination, an electric lamp socket and a jig for use in connecting at least one electric wire to the electric lamp socket. The electric lamp socket comprises first and second parts which are adapted to be fitted and locked together, the first part having at least one wire-receiving surface and the second part having a wire-contact metal terminal. The jig has a socket-receiving formation adapted to removably receive and locate the electric lamp socket, and a plurality of spaced wire-locating members defining a planar wire-laying path on the jig. When the first part of the electric lamp socket is located at the socket-receiving formation, the wire-receiving surface thereof lies in the planar wire-laying path.

In a third aspect of the invention, there is provided an electric lamp socket adapted to hold an electric lamp, having:

first and second socket parts which have been fitted together in a fitted position by moving the second part in a predetermined fitting direction relative to the first part, and a wire for electrical conduction having an electrical conductor and an insulating covering, extending from the interior of the lamp socket to the exterior thereof, the first and second socket parts having holding elements for holding the first and second parts together in the fitted position, the first socket part having a wire-locating portion comprising a first surface having a channel shape receiving and locating the wire and a second surface facing oppositely to the predetermined fitting direction and spaced along the wire from the first surface, the wire being laid on the second surface and the second surface having opposite ends in the longitudinal direction of the wire, the second socket part having a wire-contact metal terminal having two spaced-apart blades contacting the electrical conductor of the wire at respective locations of the wire at the opposite ends of the second surface, the blades engaging the wire to effect contact therewith when the first and second socket parts are fitted together.

In a fourth aspect of the invention, there is provided an electric lamp socket adapted to hold an electric lamp, having:

first and second socket parts which have been fitted together in a fitted position by moving the second part in a predetermined fitting direction relative to the first part, and a wire for electrical conduction having an electrical conductor and an insulating covering, extending from the interior of the lamp socket to the exterior thereof, the first and second socket parts having holding elements for holding the first and second parts together in the fitted position, the first and second socket parts defining an interior space, the second socket part carrying a wire-contact metal terminal which makes electrical contact with the electrical conductor of the wire in the interior space, the first socket part having a base wall and a peripheral wall upstanding from the base wall so as to surround the interior space, the peripheral wall having a slot in which the wire is located, the second socket part lying on the peripheral wall so as at least partly to close the interior space, and having a projection received in the slot so as to hold the wire in the slot.

In the method of the present invention, the automatic electric wire-laying device is allowed to move along the wire-laying path in a two-dimensional plane. Thus, the method allows the electric wire or wires to be laid more efficiently and the cost for providing and operating the automatic electric wire-laying device to be lower than in a method of involving moving the automatic electric wire-laying device three-dimensionally.

The electric bulb sockets of the invention allow the wire or wires to be easily fitted with contact with the terminal within the two-part socket, with secure holding of the wire.

BRIEF DESCRIPTION OF THE DRAWINGS

These and other objects, features and advantages of the present invention will become clear from the following description of the preferred embodiments thereof with reference to the accompanying drawings throughout which like parts are designated by like reference numerals, and in which.

DETAILED DESCRIPTION OF PREFERRED EMBODIMENTS

Figure 11:
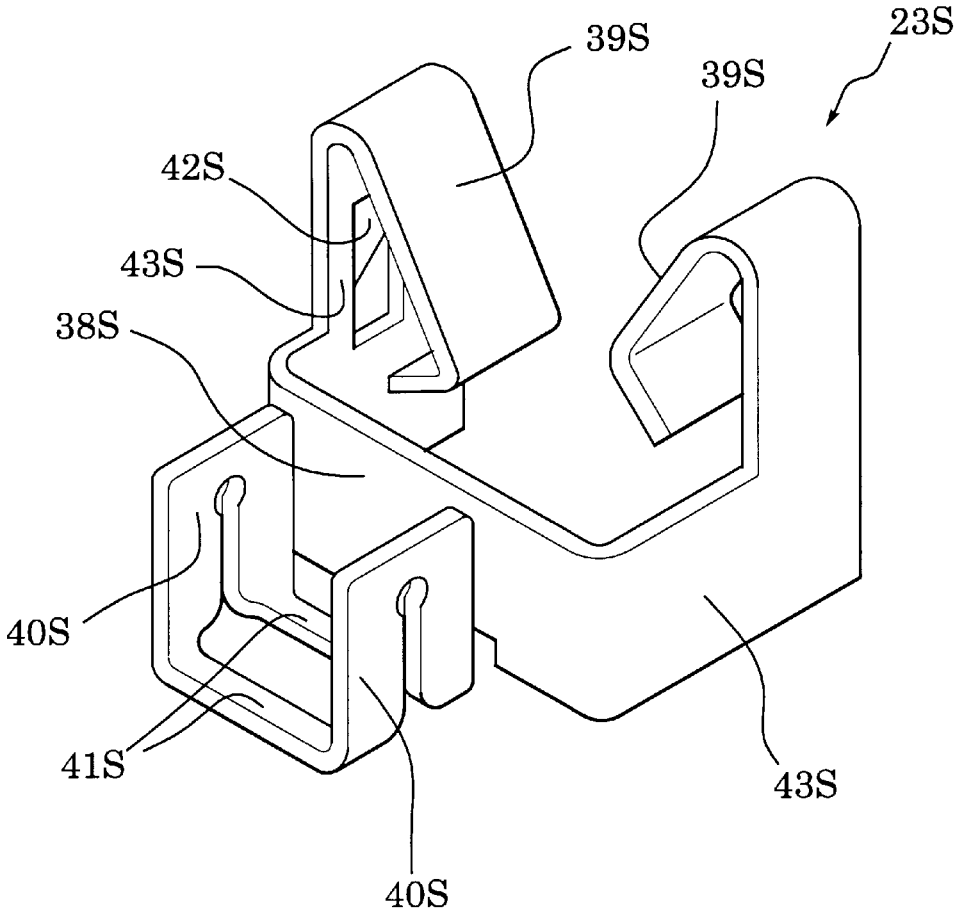
FIG. 11 is a perspective view showing a crimping terminal metal fitting which is used in the three-pole bulb socket in the first embodiment.
Figure 12:
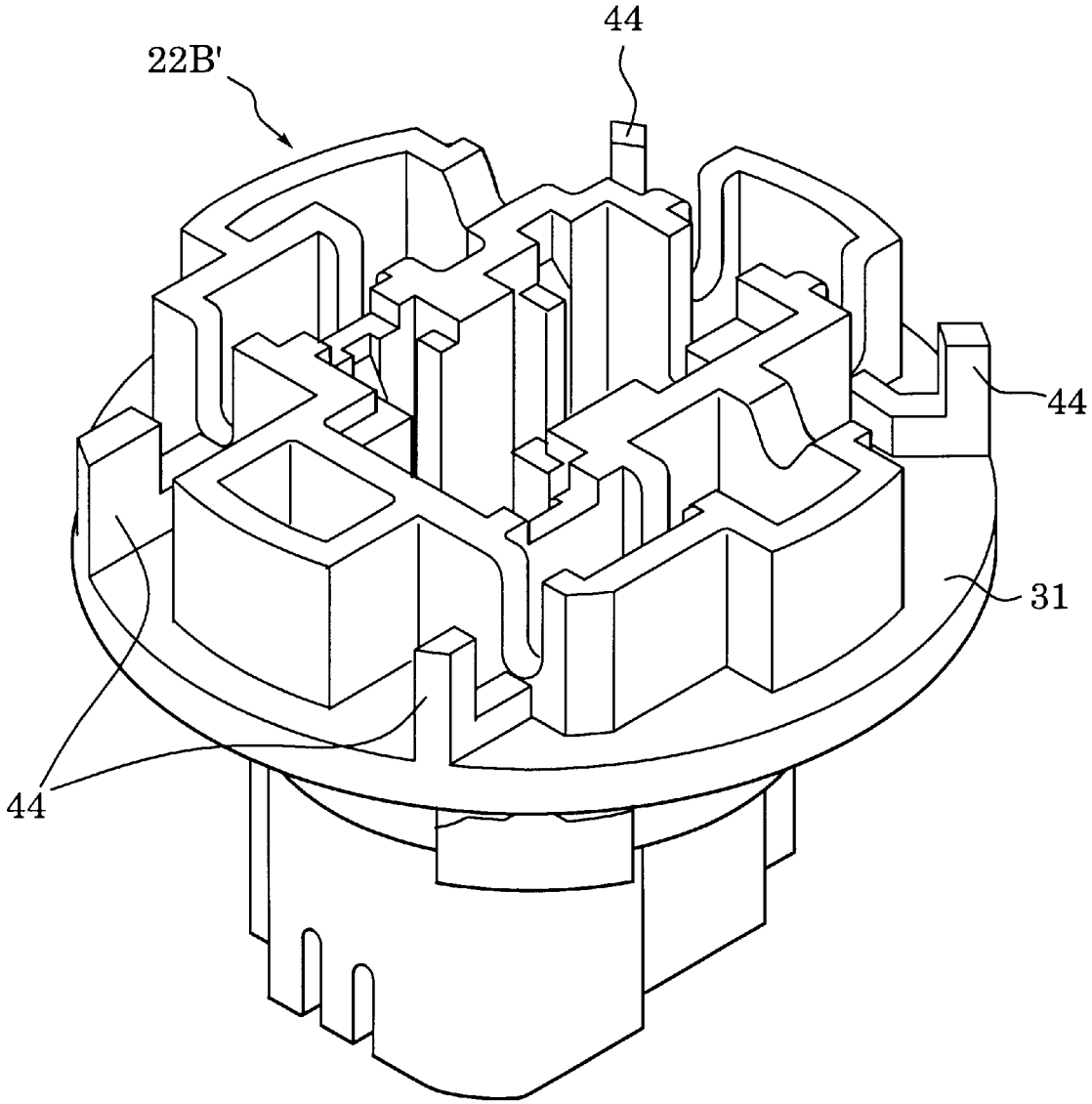
FIG. 12 is a perspective view of a modified form of the terminal side member of the first embodiment, shown upside-down relative to the orientation of the terminal side members in FIGS. 4 and 7.

An embodiment of a method of the present invention and two embodiments of electric bulb sockets of the present invention will be described below with reference to FIGS. 1 to 11. FIG. 12 shows a modified form of one part of the bulb sockets. The illustrated bulb sockets are for installation in an automobile.

Figure 1:
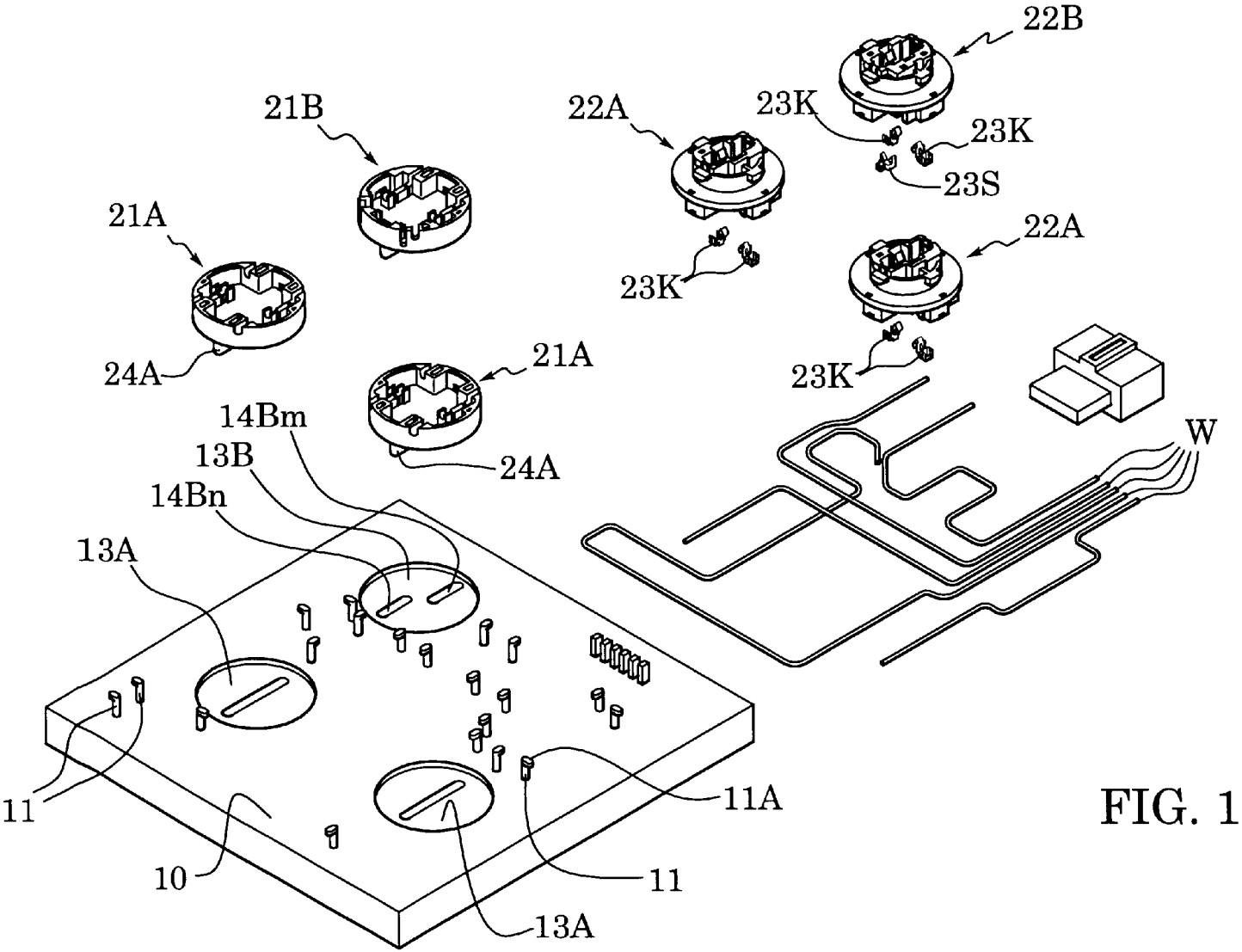
FIG. 1 is an exploded perspective view of components of a first embodiment of the present invention, comprising a jig and three electric bulb sockets.
Figure 2:
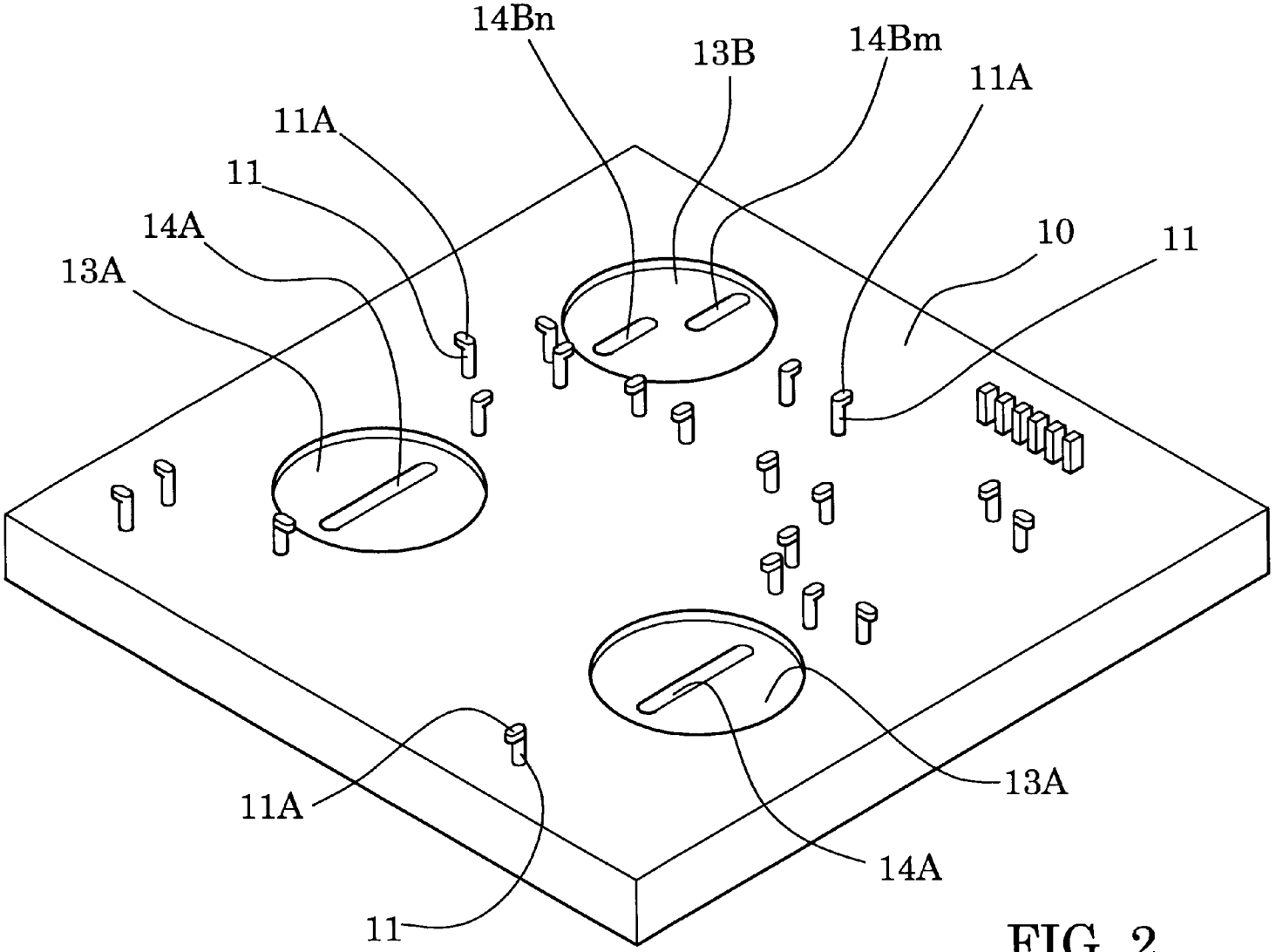
FIG. 2 is a perspective view showing the jig used in the first embodiment.
Figure 3:
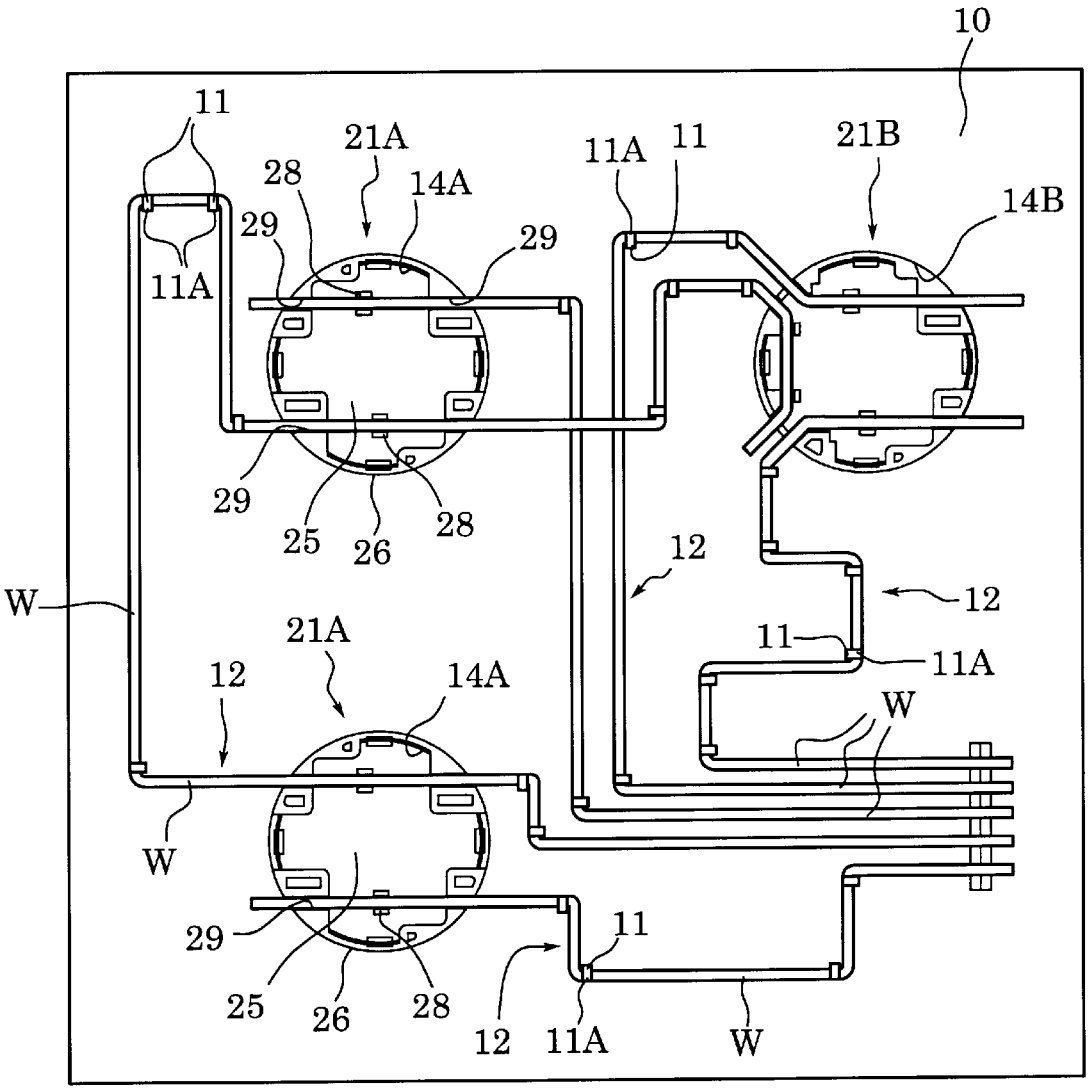
FIG. 3 is a plan view showing a state in which three receiving side members of the bulb sockets are fitted in the jig and electric wires are laid over the jig in the first embodiment.

First, a jig 10, as shown in FIGS. 1–3, is described. The jig 10 is flat, square and plate-shaped. A hook-shaped locking pin 11 projecting upwardly is formed at each of a plurality of predetermined positions on the jig 10. A projection 11A is formed at the upper end of each locking pin 11, projecting horizontally in a predetermined direction. The locking pins 11 constitute an electric wire-laying path 12 (see FIG. 3) for electric wires (W), each serving to change the direction of the electric wire (W) perpendicularly. That is, when each electric wire (W) is passed along a lower surface of each projection 11A, it is caught on each of the locking pins 11. The heights of the projections 11A of the respective locking pins 11 above the jig base are equal to each other. Accordingly, the electric wire-laying path 12 lies in a two-dimensional plane parallel with the upper surface of the jig 10.

As shown in FIGS. 1–2, socket-receiving formations in the form of two fitting recesses 13A for double-pole bulb sockets 20A and one fitting recess 13B for a triple-pole bulb socket 20B which will be described later, are formed on the upper surface of the jig 10 so that the electric wire-laying path 12 passes over them. The fitting recess 13A is circular and open upward. A positioning groove 14A is formed on the bottom surface of the fitting recess 13A, as best shown in FIG. 2. The groove 14A is linear and passes through the center of the circle of the fitting recess 13A in such a manner that the positioning groove 14A is symmetrical with respect to the center of the circle. The two fitting recesses 13A are identical to each other, and the two positioning grooves 14A are also identical to each other.

The fitting recess 13B is also circular and open upward, as best shown in FIG. 2. Two positioning grooves 14B*n* and 14B*m* are formed on the bottom surface of the fitting recess 13B and do not pass through the center of the circle of the fitting recess 13B. The positioning grooves 14B*n* and 14B*m* are different from each other in length, and neither is symmetrical with respect to the center of the circle of the fitting recess 13B.

Figure 4:
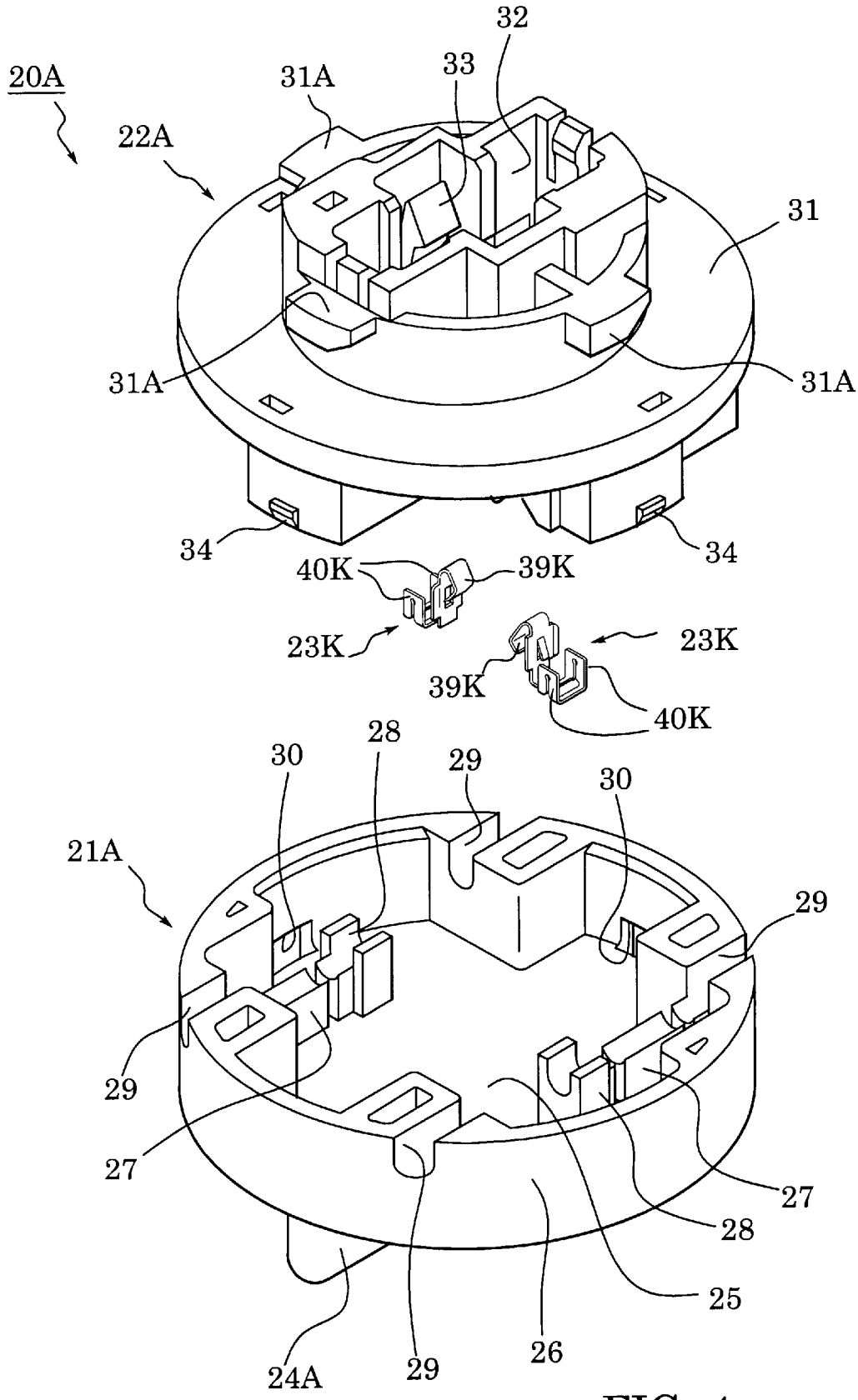
FIG. 4 is an exploded perspective view showing a two-pole bulb socket of the first embodiment.

As shown in FIG. 4, each double-pole bulb socket 20A comprises a first socket part in the form of a receiving side member 21 A, a second part in the form of a terminal side member 22A, and two common crimping terminal metal wire-contact fittings 23K. For wiring, the receiving side member 21A is removably fitted in the fitting recess 13A of the jig 10. An elongate linear positioning projection 24A which fits in the positioning groove 14A is formed on a bottom surface of the receiving side member 21A. The positioning projection 24A is also useful when manipulating the socket after its assembly. The receiving side member 21 A has a peripheral wall 26 upstanding from a circumference of a circular bottom plate 25. Two receiving portions 27 for receiving the crimped electric wire (W) (hereinafter referred to as crimping receiving portions 27) on their wire-receiving upper surfaces stand upward from an upper surface of the bottom plate 25 and are symmetrical with respect to the center of the circle of the bottom plate 25. The wire (W) laid over the jig 10 is placed on the upper surfaces of the two crimping receiving portions 27 such that the wire (W) placed on one crimping receiving portion 27 is parallel with that placed on the other crimping receiving portion 27.

The upper surface of each crimping receiving portion 27 is a shallow concave curved shape according to the shape of periphery of the wire (W). The crimping receiving portion 27 is on a level plane with the electric wire-laying path 12 defined by the locking pins 11 when the receiving side member 21A is fitted in the fitting recess 13A. A holding portion 28 in the form of an upstanding portion 28 providing an upwardly open channel shape having a curved bottom surface and side walls for holding the wire (W) at both sides thereof is located adjacent the crimping receiving portion 27 in the longitudinal direction of the wire (W) and is separated therefrom by a narrow gap of width sufficient to receive the crimping terminal blades, as described below. Escape grooves 29 are formed on the peripheral wall 26 to receive the wire (W) placed on the respective crimping receiving portions 27. These escape grooves 29 also provide upwardly open channel surfaces with curved bottom surfaces and side walls to receive and locate the wires, and each escape groove 29 is spaced from the adjacent crimping receiving portion 27 by a narrow gap of width sufficient to receive the terminal blade.

A locking recess 30 capable of engaging a locking claw 34 of the terminal side member 22A which will be described later is formed at each of four positions on the peripheral wall 26 at intervals of 90°.

The terminal side member 22A is combined with the receiving side member 21A by positioning the latter on the former and moving them together perpendicular to the jig 10. A flange 31 which matches the upper surface of the peripheral wall 26 of the receiving side member 21 A is formed at the periphery of the terminal side member 22A. A bulb-installing hole 32 vertically penetrating through the terminal side member 22A is formed in the center thereof. The bulb, not shown, is a standard replaceable automobile light bulb. A resilient holding portion 33 for holding the bulb is provided in the bulb-installing hole 32. At the lower end of the terminal side member 22A, there is formed the four locking claws 34 engaging the locking recesses 30 of the receiving side member 21 A, thus holding the receiving side member 21 A and the terminal side member 22A locked together in the fitted position.

At its upper end, the terminal side member 22A has four lateral projections 31A for use in fitting it e.g. in a bayonet fitting manner, into e.g. a tail lamp assembly of an automobile.

Figure 5:
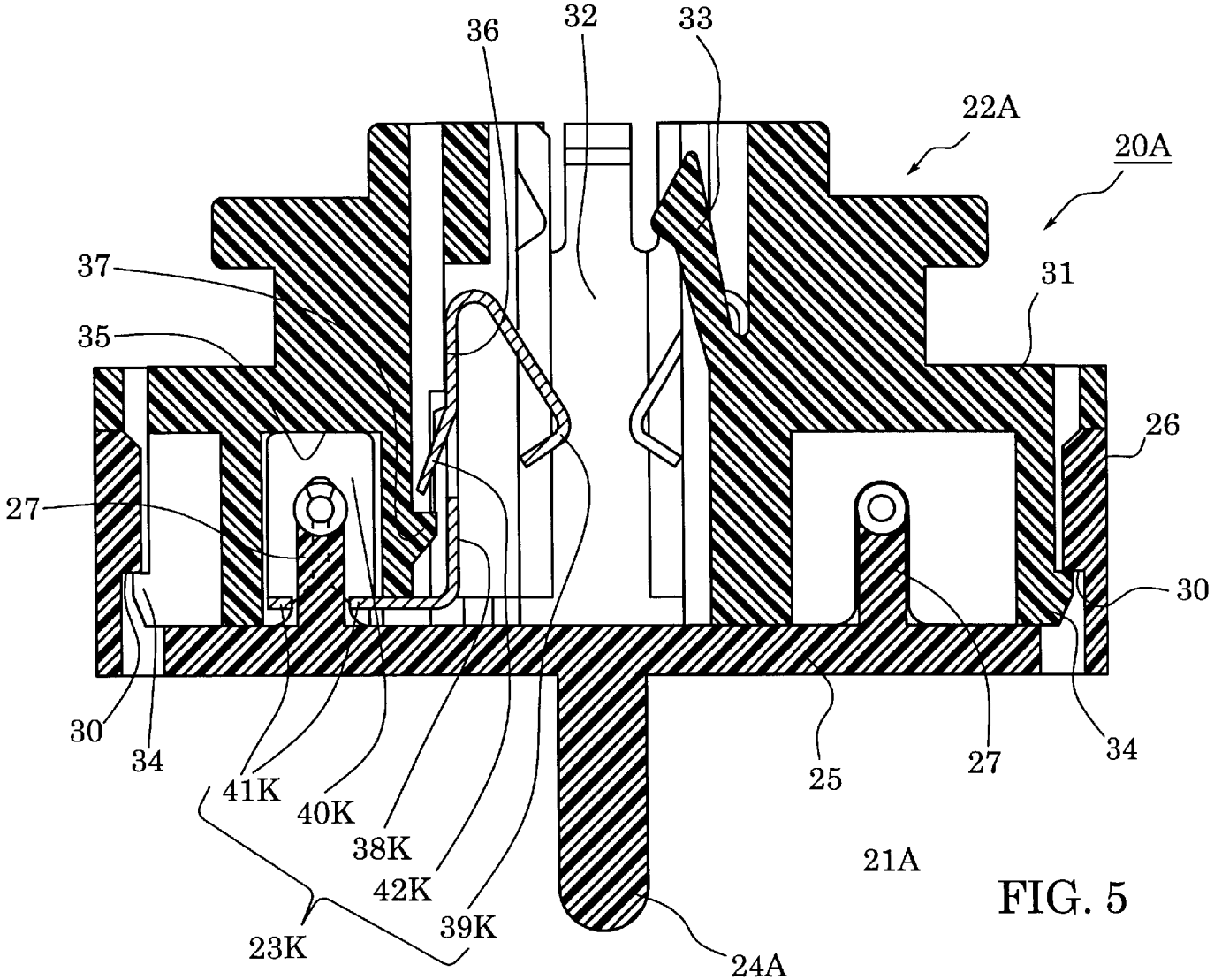
FIG. 5 is a cross-sectional view showing the connected state of the two-pole bulb socket in the first embodiment.

Two identical crimping terminal metal wire-contact fittings 23K are installed on the terminal side member 22A. The terminal side member 22A has two crimping blade-accommodating portions 35 (see FIG. 5) formed at the center thereof, are open at the lower surface thereof and symmetrical with respect to the center of the circle of the terminal side member 22A. In FIG. 5, there are formed in the bulb-installing hole 32 two contact portion-accommodating portions 36 symmetrical with respect to the center of the circle of the terminal side member 22A. A removal-preventing projection 37 for preventing the metal wire-contact fitting 23K from being removed from the terminal side member 22A is formed in each contact portion-accommodating portion 36.

Figure 6:
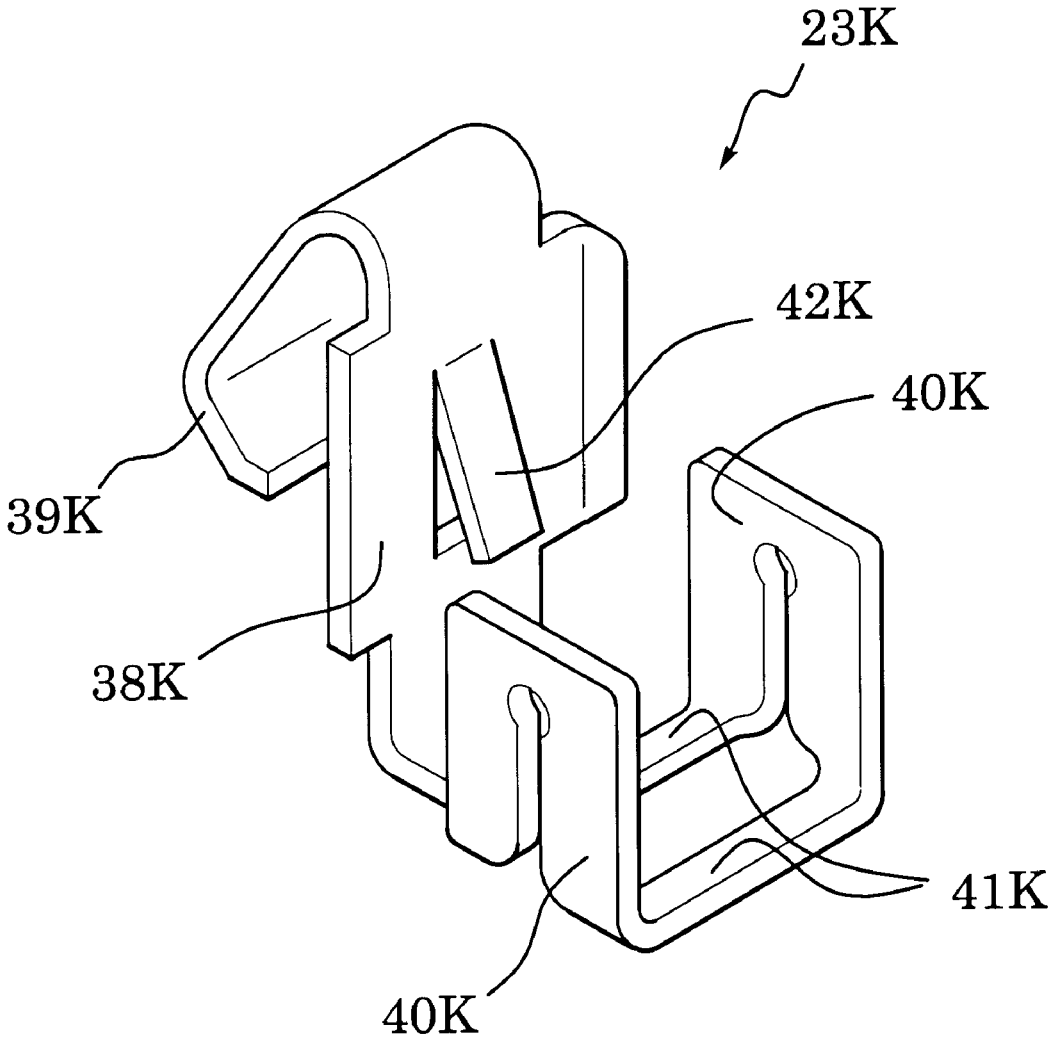
FIG. 6 is a perspective view showing a crimping terminal metal fitting used in the two-pole bulb sockets and a three-pole bulb socket in the first embodiment.

As shown in FIG. 6, the common metal wire-contact fitting 23K comprises a plate-shaped vertical body 38K, a contact portion 39K extending obliquely downwardly from the upper end of the plate-shaped vertical body 38K, a pair of crimping blades 40K extending from the lower end of the plate-shaped vertical body 38K in the direction opposite to the position of the contact portion 39K, a pair of connection portions 41K connecting both crimping blades 40K with each other, and a rectangular resilient locking portion 42K raised from the plate-shaped vertical body 38K toward the crimping blades 40K by cutting the plate-shaped vertical body 38K in an approximate U-shape.

With reference to FIG. 5, the metal wire-contact fitting 23K is installed on the terminal side member 22A by inserting the plate-shaped vertical body 38K upward into the contact portion-accommodating portion 36 and inserting the crimping blades 40K into the crimping blade-accommodating portion 35. In the state in which the metal wire-contact fitting 23K has been installed on the terminal side member 22A, the locking portion 42K engages the removal-prevention projection 37, thus holding the metal wire-contact fitting 23K installed on the terminal side member 22A; the contact portion 39K faces the bulb-installing hole 32 and is located at a position at which the contact portion 39K can contact an electrode of the bulb; and the pair of crimping blades 40K are positioned at both sides of each crimping receiving portion 27 of the receiving side member 21A, as shown in FIG. 5.

Figure 7:
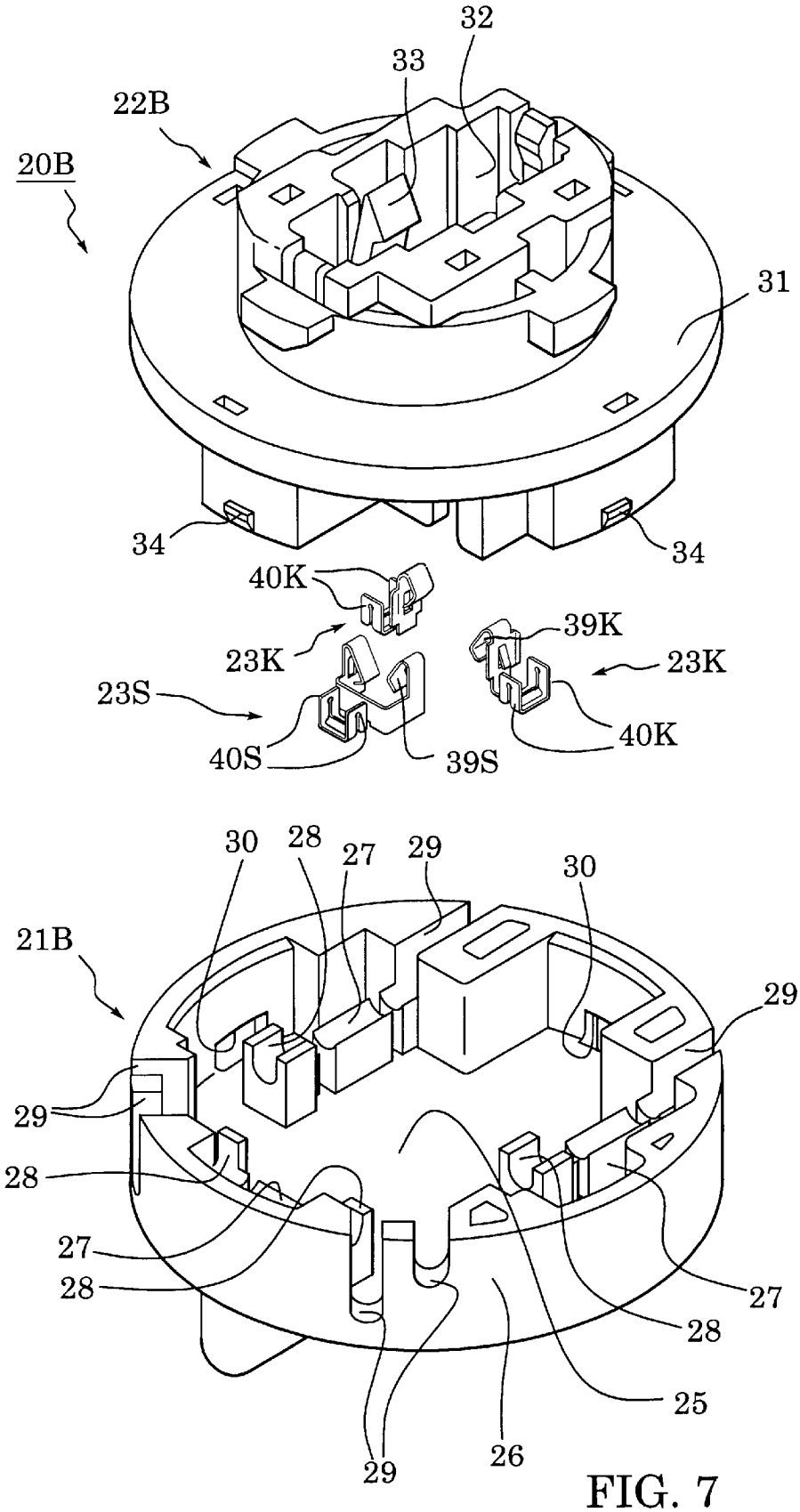
FIG. 7 is an exploded perspective view showing the three-pole bulb socket of the first embodiment.

Referring to FIG. 7, a triple-pole bulb socket 20B comprises a receiving side member 21B, a terminal side member 22B, two common crimping terminal metal wire-contact fittings 23K, and a crimping terminal metal fitting 23S which is exclusively used for the triple-pole bulb socket 20B. The construction of the triplepole bulb socket 20B is similar to that of the double-pole bulb socket 20A except that the number of poles of the triple-pole bulb socket 20B is different from that of the double-pole bulb socket 20A. Thus, the constructions of the triple-pole bulb socket 20B which are the same as those of the double-pole bulb socket 20A are denoted by the same reference numerals of the double-pole bulb socket 20A, and their detailed description thereof is omitted here.

Three crimping receiving portions 27 are formed on the first socket part which is the receiving side member 21B. Two of the three crimping receiving portions 27 are located at the same positions as those of the double-pole bulb socket 20A, and have adjacent them holding portions 28 and escape grooves 29 providing upward channels for wire-location as in the double-pole socket 20A. The third of the crimping receiving portions 27 is at right angles to the other two and is located intermediate between the other two and close (left position in FIG. 8) to the peripheral wall 26. Two formations providing holding portions 28 with upward channels for wire location are provided adjacent opposite longitudinal ends of this third crimping receiving portion 27, with narrow gaps for the terminal blades.

Figure 8:
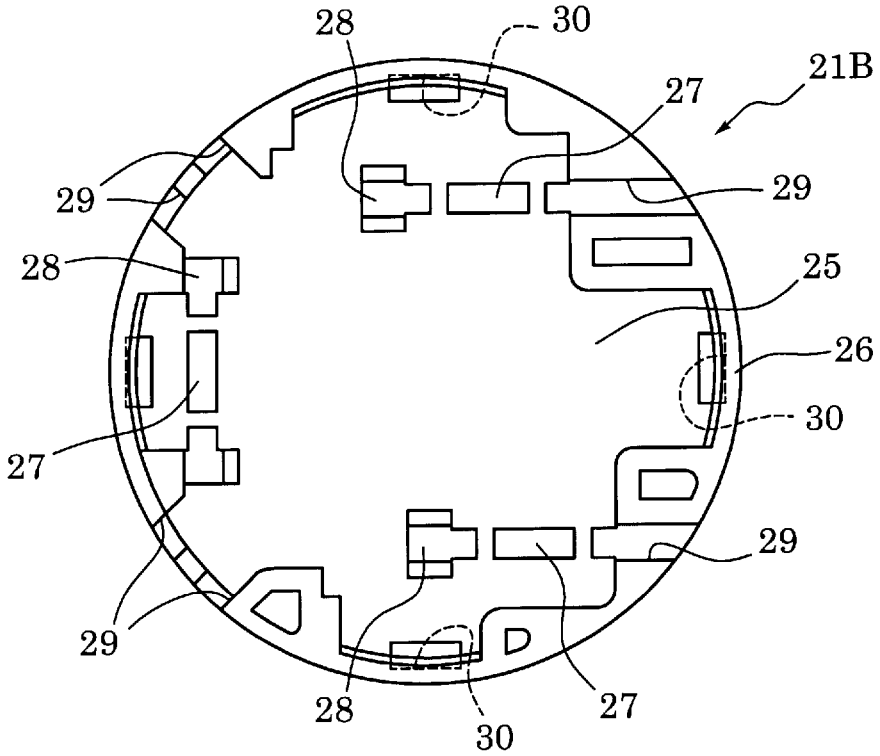
FIG. 8 is a plan view showing a receiving side member of the three-pole bulb socket in the first embodiment.
Figure 9:
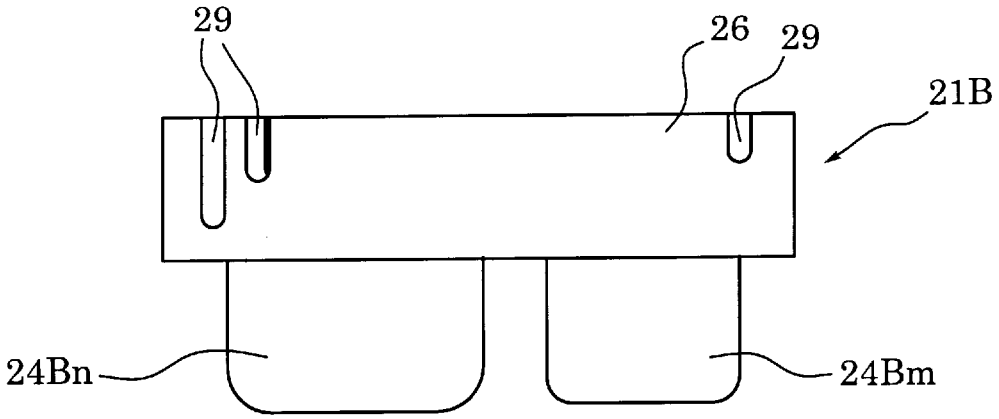
FIG. 9 is a front elevation view showing the receiving side member of the three-pole bulb socket in the first embodiment.
Figure 10:
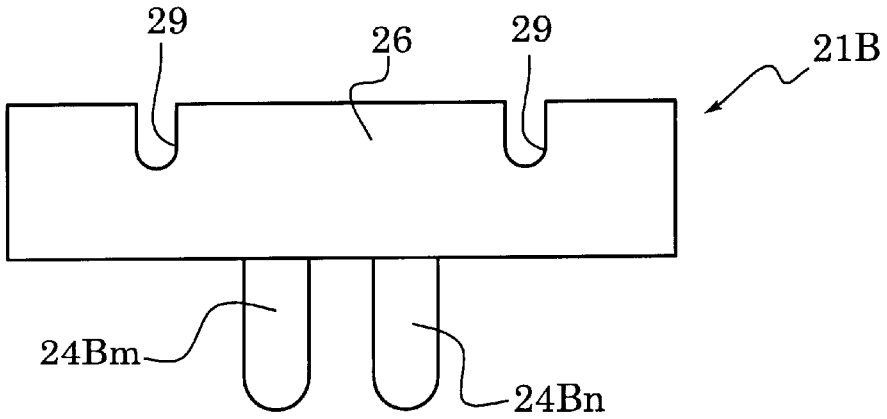
FIG. 10 is a side elevation view showing the receiving side member of the three-pole bulb socket in the first embodiment.

Six escape grooves 29 are formed on the peripheral wall 26. Two escape grooves 29 at the right side in FIG. 8 are located at the same positions as those of the double-pole bulb socket 20A. Two of the other four escape grooves 29 are positioned in one region at the left side of the receiving side member 21 B. The other two are positioned in the other region at the left side of the receiving side member 21B. The two escape grooves 29 in each region are close to each other and radially directed.

Two positioning projections 24B*m* and 24B*n* (see FIG. 9) correspond to the positioning grooves 14B*m* and 14B*n* of the fitting recess 13B, respectively. The positioning projections 24B*m* and 24B*n* are different from each other in length, and they are not symmetrical with respect to the center of the circle of the receiving side member 21 B.

The second socket part which is the terminal side member 22B has three crimping blade-accommodating portions 35 corresponding to the three crimping receiving portions 27 of the receiving side member 21 B. Similarly to the double-pole bulb socket 20A, a common crimping terminal metal wire-contact fitting 23K is mounted on each of the two crimping blade-accommodating portions 35 located at the same positions as those of the double-pole bulb socket 20A. The crimping terminal metal fitting 23S is mounted on one of the crimping blade-accommodating portions 35. As shown in FIG. 11, the crimping terminal metal fitting 23S comprises a plate-shaped body 38S, a pair of L-shaped arm portions 43S each extending perpendicularly from the right and left edges of the plate-shaped body 38S, a pair of contact portions 39S each extending obliquely inwardly downward from the upper end of each L-shaped arm portion 43S, a pair of crimping blades 40S extending from the lower end of the plate-shaped body 38S to the side opposite to the position of the contact portion 39S, a pair of connection portions 41S connecting both crimping blades 40S with each other, and a removal-preventing portion 42S raised from one of the L-shaped arm portions 43S to the side opposite to the position of the contact portion 39S by cutting one of the L-shaped arm portions 43S in an approximate shape of a "U". The mounting construction of the crimping terminal metal fitting 23S on the terminal side member 22B is similar to that of the common crimping terminal metal fitting 23K on the terminal side member 22A and is omitted here.

Each socket part 21A, 21B, 22A, 22B is suitably formed in one-piece of plastics material by injection molding. The two mating socket parts are shaped so as to fit together in only one relative orientation, and to slide into their fitted position by movement in one direction. The wires (W) are conventional, having a plastic insulating covering on a twisted multi-filament core.

The procedure of connecting the bulb socket and the electric wires (W) with each other by using the jig 10 of the embodiment will now be described.

First, the jig 10 is fixed horizontally and then, the receiving side members 21 A and the receiving side member 21 B are fitted in the fitting recesses 13A and the fitting recess 13B, respectively. Because the positioning projection 24A of the double-pole bulb socket 20A and the positioning groove 14A of the fitting recess 13A are symmetrical with respect to the center of the receiving side member 21 A and the center of the fitting recess 13A, respectively, each receiving side member 21 A may be fitted in the fitting recess 13A in either of opposite orientations (rotated through 180°). On the other hand, the triple-pole bulb socket 20B is fitted in the fitting recess 13B in only the predetermined position because the positioning grooves 14B*n* and 14B*m* are not symmetrical with respect to the center of the circle of the fitting recess 13B, and the positioning projections 24B*m* and 24B*n* are not symmetrical with respect to the center of the circle of the receiving side member 21B.

After the receiving side members 21A and the receiving side member 21B are fitted in the fitting recesses 13A and 13B, respectively, a plurality of electric wires (W) (five in the embodiment, as shown in FIG. 3) are laid along the planar electric wire path 12 by an automatic electric wire-laying device (not shown). In laying the electric wires (W), a nozzle (not shown) of the wire-laying device moves along the path 12 while the electric wires (W) are discharged from the nozzle, with one end of each wire from the nozzle being held at a predetermined position by fingers (not shown) or the like. In the wire-laying process, the electric wires (W) are caught on the projection 11A of each of the locking pins 11, while the movement direction of the nozzle is changed perpendicularly at each locking pin 11. The wires (W) are fitted in the escape grooves 29 and holding portions 28 of the receiving side member 21A and the receiving side member 21B and placed on the curved upper surface of each crimping receiving portion 27 as shown in FIG. 3.

The height of the electric wire-laying path 12 with respect to the jig 10 is made constant by means of the locking pins 11 and the crimping receiving portions 27. That is to say, the shape of the electric wire-laying path 12 is two-dimensional, which allows the nozzle to move two-dimensionally.

After the wires (W) are laid in the above-described manner, the terminal side members 22A and the terminal side member 22B are combined with the receiving side members 21A and the receiving side member 21B respectively, by pushing the terminal side members 22A and terminal side member 22B onto the receiving side members 21A and receiving side member 21B, respectively. In performing the combining operation, a pair of the crimping blades 40K and a pair of the crimping blades 40S become positioned in the gaps at both longitudinal ends of the respective crimping receiving portions 27 and are pressed against the wires (W) placed on the upper surface of the crimping receiving portion 27. The locking claws 34 engage the locking portions 30. Consequently, the receiving side member 21A and the terminal side member 22A are held in the combined state, the terminal side member 21B and terminal side member 22B are also held in the combined state, and the crimping blades 40K and 40S remain pressed against the wires (W). In this manner, the wires (W) are connected with the double-pole bulb socket 20A and the triple-pole bulb socket 20B. The connection portions 41K are sufficiently far apart to pass on each side of the crimping receiving portion 27.

As particularly FIGS. 5 and 11 show, each crimping blade 40K, 40S has a key-hole shaped slot defined by metal edges which engage the wire on both sides and cut through the insulating covering of the wire to make contact with and compress (crimp) the twisted multi-filament conductive core of the wire. In FIG. 5, the core is indicated by a filled circle. The use of two blades, spaced apart along each wire in this manner, is advantageous in this specific case, because it results in a tighter gripping of the multi-filament core. That is to say, a twisted multi-filament conductor tends to untwist especially when the outer covering is cut. Untwisting loosens the gripping effect. This tendency to untwist is prevented or reduced by gripping the core at two slightly spaced locations, as in the present embodiment.

Though not shown in FIGS. 1 to 11, it is preferred that the terminal side members 22A and 22B have downwardly extending projections at the periphery of the flange 31 at locations of the escape grooves 29. FIG. 12 shows a modified terminal side member 22B' of the bulb socket in which four such downward projections 44 are present, at locations corresponding to four of the grooves 29 in the receiving side member 21B of FIG. 7. These projections slide into the escape grooves 29 on fitting together of the socket parts 21A, 21B, 22A, 22B so as to trap and clamp the wires (W)

in the bases of the escape grooves 29. This assists the secure holding of the wires in the socket, and minimize any risk of loosening or detachment of the wires from the terminals inside the sockets. Full description of FIG. 12 is not necessary, since the terminal side member shown generally corresponds to the terminal side member of FIG. 7. The locking claws 34 are omitted in FIG. 12, for simplicity of drawing.

After the wires (W) are so connected, the assembly of double-pole bulb sockets 20A, triple-pole bulb socket 20B, and the wires (W) are removed from the jig 10. Then, the sockets 20A and 20B are fixed to an installation member (not shown) such as a holder of a combination lamp for installation in an automobile, and the wires (W) are laid as desired to predetermined positions, for example in a three-dimensional arrangement.

As described above, because the wire-laying path 12 and the upper surface of each crimping receiving portion 27 are positioned in the same two-dimensional plane in the embodiment, the nozzle of the wire-laying device is allowed to move this two-dimensional plane, irrespective of the position of the double-pole bulb socket 20A and that of the triple-pole bulb socket 20B. Thus, the method of the present invention allows the wires (W) to be laid more efficiently and the cost for equipping the automatic electric wire-laying device to be lower than a method of laying the wires (W) by moving the automatic electric wire-laying device three-dimensionally.

Further, because the wires (W), and the sockets 20A and 20B are removed from the jig 10 after the wires (W) are laid over the jig 10, the method of the present invention can be carried out flexibly, irrespective of the position of the sockets 20A and 20B. Further, the wires (W) can be long enough to be laid along the final predetermined path by making the electric wire-laying path 12 sufficiently long.

Figure 13:
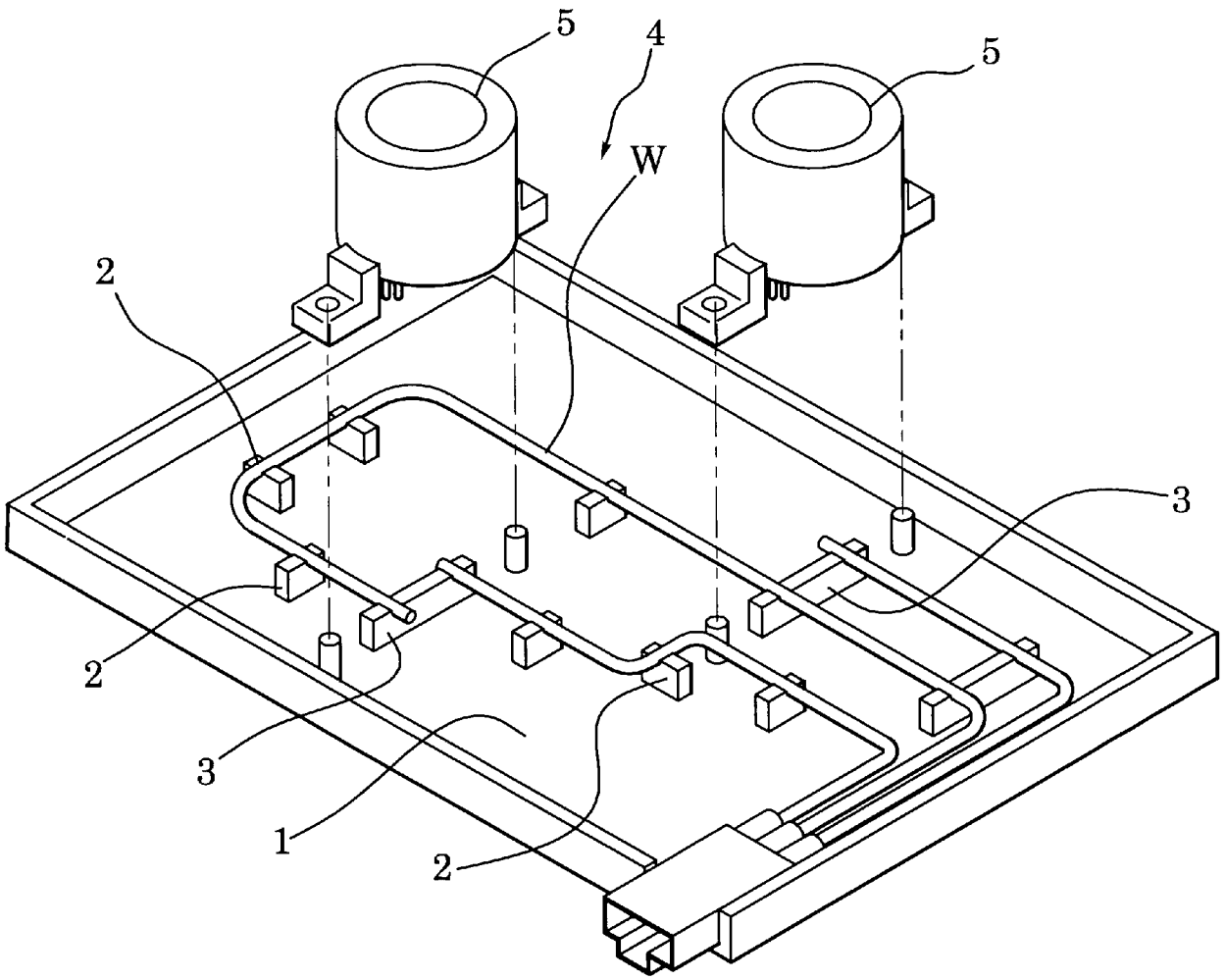
FIG. 13 RELATED ART
FIG. 13 is a perspective view showing a known method of connecting bulb sockets and electric wires with each other described above.

Also the sockets can be positioned in a lamp assembly in various relative positions as desired, not merely their relative positions when connected to wires as in FIG. 13.

In the state in which the wires (W) and the sockets 20A and 20B have been removed from the jig 10, the wires (W) are not likely to be removed from the crimping blades 40K and 40S. This is because the receiving side member 21A and the terminal side member 22A are combined with each other, and the receiving side member 21B and the terminal side member 22B are combined with each other, thus allowing each crimping receiving portion 27 to hold the wires (W), with the wires (W) interposed between the crimping receiving portions 27 and the crimping blades 40K and 40S.

Further, because of the arrangement of the positioning grooves 14A, 14B*m*, 14B*n* on the fitting recesses 13A, 13B, and the positioning projections 24A, 24B*m*, 24B*n* on the receiving side members 21A, 21B, the receiving side members 21A and 21B can be fitted in the fitting recesses 13A and 13B in the correct predetermined position relationships. In addition, the triple-pole bulb socket 20B is prevented from being fitted in the fitting recess 13A, and also the double-pole bulb socket 20A is prevented from being fitted in the fitting recess 13B.

The present invention is not limited to the embodiment described above with reference to the drawings, but includes embodiments described below.

The electric wire-laying path 12 of the wires (W) may be located at desired positions over the jig 10 instead of that shown in the above-described embodiment, and the crimping receiving portions 27 may be also located at desired positions of the receiving side members 21A and 21B, instead of those shown in the above-described embodiment.

The wires (W) may be laid on the double-pole bulb socket 20A and the triple-pole bulb socket 20B at any desired positions thereof instead of those shown in the above-described embodiment.

The fitting recesses 13A, 13B and the receiving side members 21A, 21B are circular in the illustrated embodiment, but may be square or of other shapes.

In the embodiment, the receiving side members 21A, 21B can be correctly fitted in the fitting recesses 13A and 13B, owing to the positioning grooves 14A, 14B*m*, 14B*n* and the positioning projections 24A, 24B*m*, and 24B*n*. Within the present invention, erroneous fitting of the receiving side members 21A and 21B can be prevented by otherwise differentiating the outer configurations of the receiving side members 21A and 21B from each other and those of the fitting recesses 13A and 13B from each other.

It is possible to appropriately select the number of the fitting recesses 13A, 13B which are formed on the jig 10 and their positions. It is also possible to appropriately select the number of the crimping terminal metal wire-contact fittings which are installed on the terminal side members 22A and 22B and their positions.

Although the present invention has been fully described by the preferred embodiments thereof with reference to the accompanying drawings, it is to be noted that various changes and modifications are apparent to those skilled in the art. Such changes and modifications are to be understood as included within the scope of the present invention.

What is claimed is:

1. A method of connecting at least one electric lamp socket and at least one electric wire that includes an electrical conductor and an insulating covering, wherein said electric lamp socket comprises first and second parts which are adapted to be fitted and locked together, said first part having a wire-locating portion including a first surface having a channel shaped for receiving and locating said at least one electric wire and a second surface facing oppositely to a predetermined fitting direction and spaced along said at least one electric wire from said first surface, said second surface having opposite ends in the longitudinal direction of the at least one electric wire and said second part having a wire-contact metal terminal having two spaced-apart blades contacting said electrical conductor of said at least one electric wire at respective locations of said at least one electric wire at said opposite ends of said second surface, said blades engaging said at least one electric wire to effect contact therewith when said first and second socket parts are fitted together, the method comprising the steps of:

(i) locating said first part of said electric lamp socket at a position such that at least said second surface lies in a wire-laying path that extends from an exterior of said first part of said electric lamp socket to an interior thereof, (ii) laying said at least one electric wire along said wire-laying path and on at least said second surface, and (iii) fitting and locking said second part of said electric lamp socket to said first part thereof in the predetermined fitting direction so that said wire-contact metal terminal engages said at least one electric wire laid on said second surface so as to make electrical connection therewith.

2. A method according to claim 1, wherein said wire-contact metal terminal is a wire-crimping metal terminal which crimps said wire when engaged therewith.

3. A method according to claim 1, wherein said wire-laying path is a planar wire-laying path.

4. A method according to claim 1, wherein a jig defines said wire-laying path.

5. A method according to claim 1, wherein locating said first part of said electric lamp socket comprises positioning said first part of said electric lamp socket on a jig.

6. A method according to claim 5, further comprising removing said electric lamp socket and said at least one electric wire connected thereto from said jig.

7. A method according to claim 5, wherein the at least one electric lamp socket comprises a plurality of electric lamp sockets.

8. A method according to claim 5, wherein said jig has a plurality of spaced-apart wire-locating members located along said planar wire-laying path.

9. A method according to claim 5, wherein said jig has at least one recess to removably receive and locate said first part of said electric lamp socket.

10. An electric lamp socket adapted to hold an electric lamp, comprising:

first and second socket parts which have been fitted together in a fitted position by moving said second socket part in a predetermined fitting direction relative to said first socket part, and a wire for electrical conduction having an electrical conductor and an insulating covering, extending from an interior of the lamp socket to an exterior thereof, said first and second socket parts having holding elements for holding said first and second socket parts together in said fitted position, said first socket part having a wire-locating portion including a first surface having a channel shaped for receiving and locating said wire and a second surface facing oppositely to said predetermined fitting direction and spaced along said wire from said first surface, said wire being laid on said second surface and said second surface having opposite ends in the longitudinal direction of the wire, said second socket part having a wire-contact metal terminal having two spaced-apart blades contacting said electrical conductor of said wire at respective locations of said wire at said opposite ends of said second surface, said blades engaging said wire to effect contact therewith when said first and second socket parts are fitted together.

11. An electric lamp socket according to claim 10, wherein each said blade of said wire-contact metal terminal has a slot in which said electrical conductor is gripped, said electrical conductor being a plurality of filaments twisted together.

12. A jig used in combination with the electric lamp socket of claim 9, said jig comprising:

a socket-receiving formation adapted to removably receive and locate said electric lamp socket, and a plurality of spaced-apart wire-locating members located along a wire-laying path on said jig, wherein when said first part of said electric lamp socket is located at said socket-receiving formation, said second surface lies in said wire-laying path.

13. An electric lamp socket according to claim 10, wherein said wire-locating portion of said first socket part has a third surface having a channel shaped for receiving and locating said wire, said third surface being spaced along said wire from said second surface, the second surface being positioned between the first surface and the third surface.

14. An electric lamp socket according to claim 13, wherein one of said first and third surfaces of said wire-locating portion is provided with a slot in a peripheral wall of said first socket part.

15. An electric lamp socket adapted to hold an electric lamp, comprising:

first and second socket parts which have been fitted together in a fitted position by moving said second socket part in a predetermined fitting direction relative to said first socket part, and a wire for electrical conduction having an electrical conductor and an insulating covering, extending from an interior space of the lamp socket to an exterior thereof, said first and second socket parts having holding elements for holding said first and second socket parts together in said fitted position, said first and second socket parts defining said interior space, said second socket part carrying a wire-contact metal terminal which makes electrical contact with said electrical conductor of said wire in said interior space, said first socket part having a base wall and a peripheral wall upstanding from said base wall so as to surround said interior space, said peripheral wall having a slot in which said wire is located, said second socket part lying on said peripheral wall so as to at least partially close said interior space, and having a projection received in said slot so as to hold said wire in said slot.

16. An electric lamp socket according to claim 15, wherein said projection clamps said wire at a base of said slot.

* * * * *